United States Patent [19]

Miller

[11] Patent Number: 5,048,585

[45] Date of Patent: Sep. 17, 1991

[54] PANEL DEVICE

[75] Inventor: Melvin M. Miller, Bloomington, Ind.

[73] Assignee: Channel - Kor Systems Inc., Bloomington, Ind.

[21] Appl. No.: 441,463

[22] Filed: Nov. 27, 1989

Related U.S. Application Data

[62] Division of Ser. No. 144,166, Nov. 25, 1985.

[51] Int. Cl.[5] ..... A47G 5/00

[52] U.S. Cl. ..... 160/135; 160/351; 248/121

[58] Field of Search ..... 160/135, 351; 248/121

[56] References Cited

U.S. PATENT DOCUMENTS

| | | | |
|---|---|---|---|
| 3,592,288 | 7/1971 | Walter | 160/351 X |
| 3,592,289 | 4/1971 | Aysta | 160/351 X |
| 3,700,385 | 10/1972 | Sherwood | 160/135 X |
| 4,021,973 | 5/1977 | Hegg et al. | 160/351 X |
| 4,129,163 | 12/1978 | Johnson | 160/135 |
| 4,497,356 | 2/1985 | Luck et al. | 160/135 |

*Primary Examiner*—J. Franklin Foss

[57] ABSTRACT

This invention is converned with a panel device which is useful in the display and furniture arts. The panel device incorporates a plurality of vertical supports which engage panel members. The vertical supports are interconnected via a plurality of double hinges. The double hinges consist of a plurality of clip hinge members. Each double hinge consists of at least two clip hinge members. Pairs of parallel vertical supports are interconnected by a pair of double hinges said double hinges comprising at least four clip hinge elements. The clip hinge elements are formed from a ribbon of a suitable flexible material. The ends of the clip hinge members incorporate opposing double reverse bends which are adapted to engage and be secured in U shaped channels which are an integral part of the vertical support members. The reverse bends may further incorporate locking tabs to assist in securing the clip hinge elements into the vertical supports. Pairs of parallel vertical supports are secured in fixed relationship with each other by horizontal supports. The interconnecting vertical and horizontal supports define frame which receive and secure panel members. The panel device consists of a plurality of related panel sections which can be rotated throughout a 360 arc in relation to each other. The vertical supports incorporate integral means for gripping appropriate panels.

7 Claims, 5 Drawing Sheets

FIG. 1
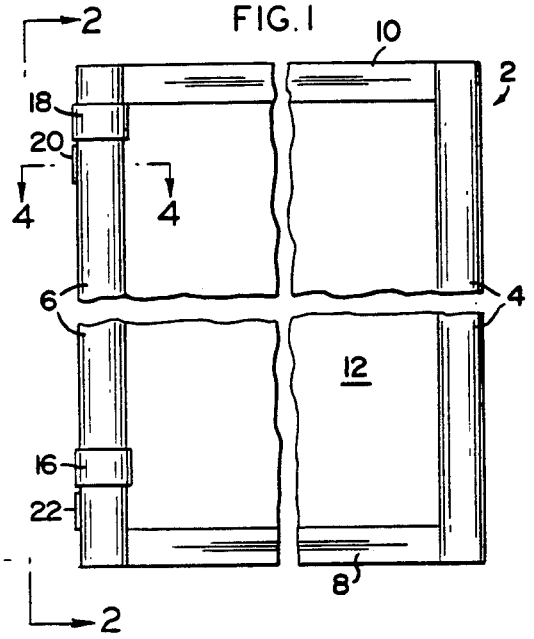
FIG. 3A
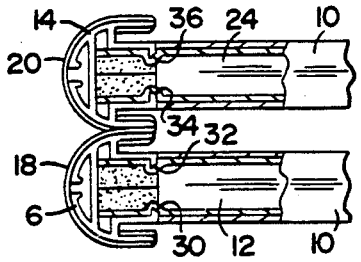
FIG. 3B
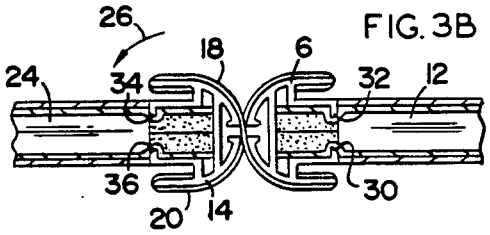
FIG. 3C
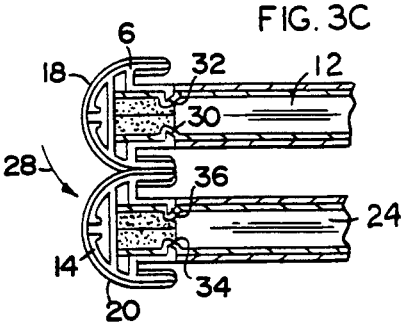
FIG. 2
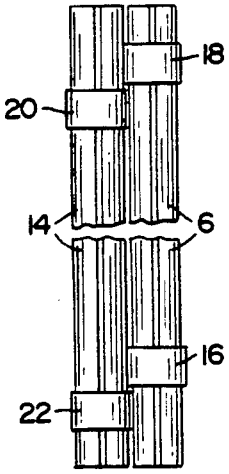
FIG. 4
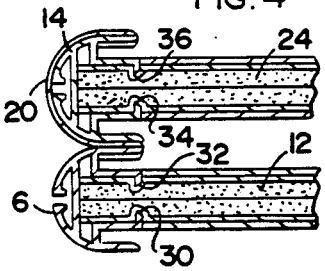
FIG. 6
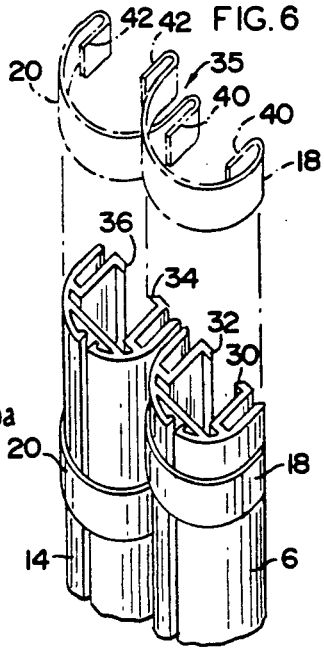
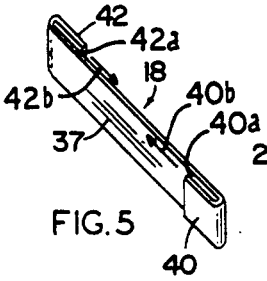
FIG. 5
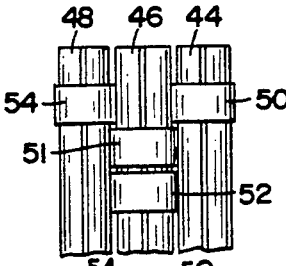
FIG. 7
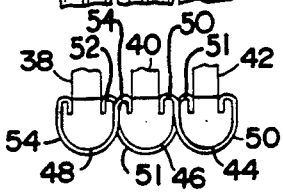
FIG. 8
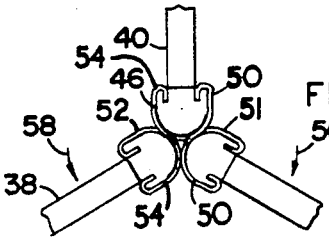
FIG. 8A FIG. 17
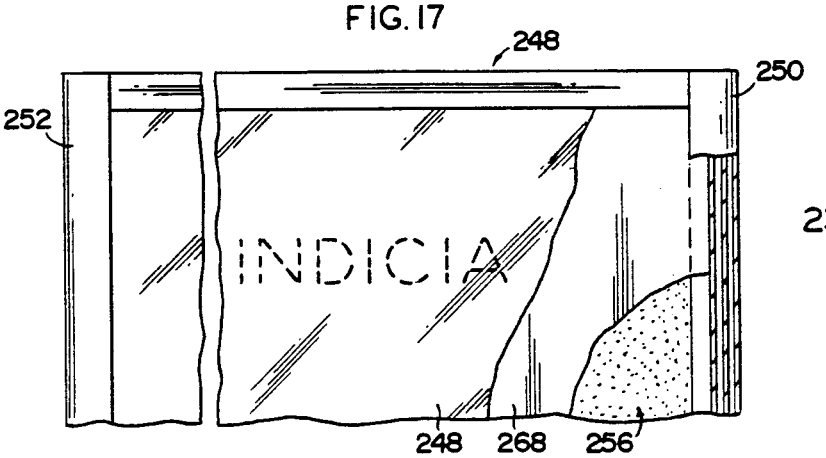
FIG. 23A
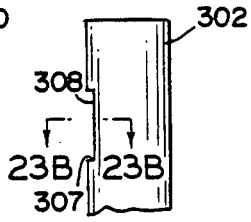
FIG. 23B
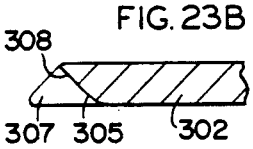
FIG. 18
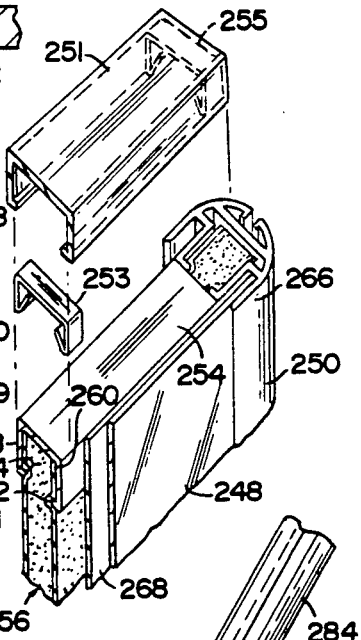
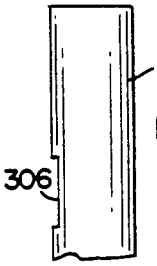
FIG. 24
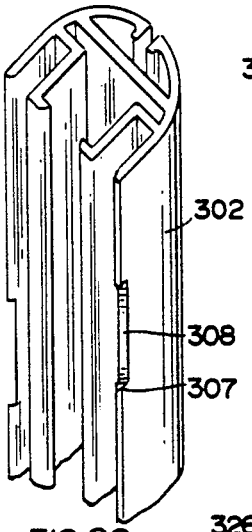
FIG. 22
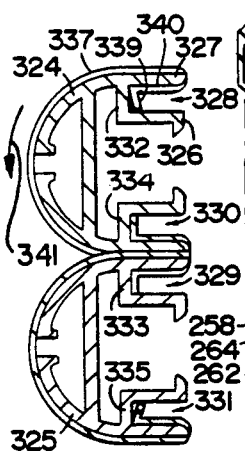
FIG. 27
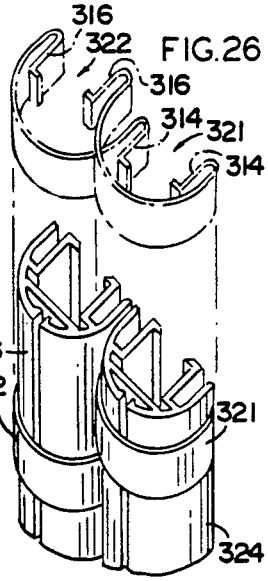
FIG. 26
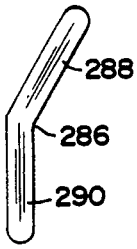
FIG. 20
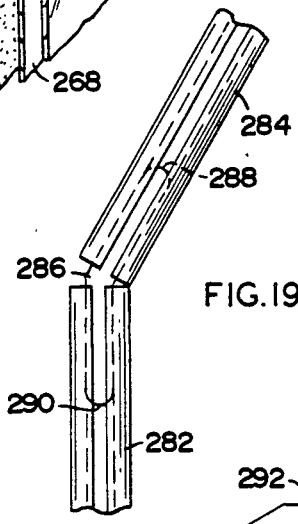
FIG. 19
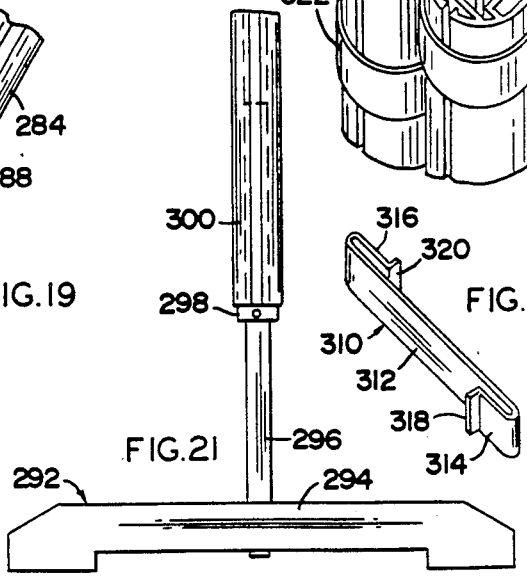
FIG. 21
FIG. 25

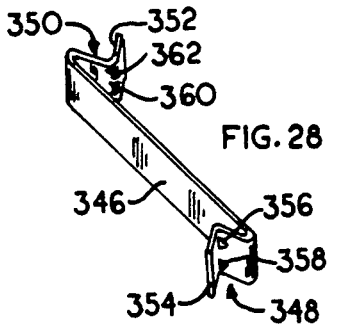
FIG. 28
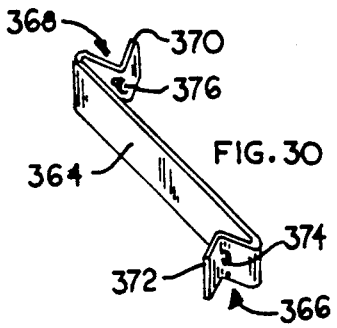
FIG. 30
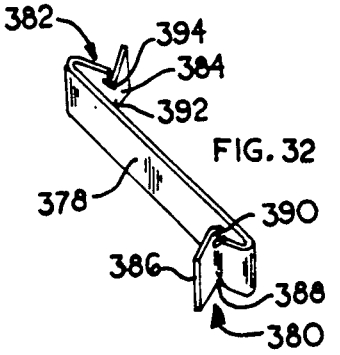
FIG. 32
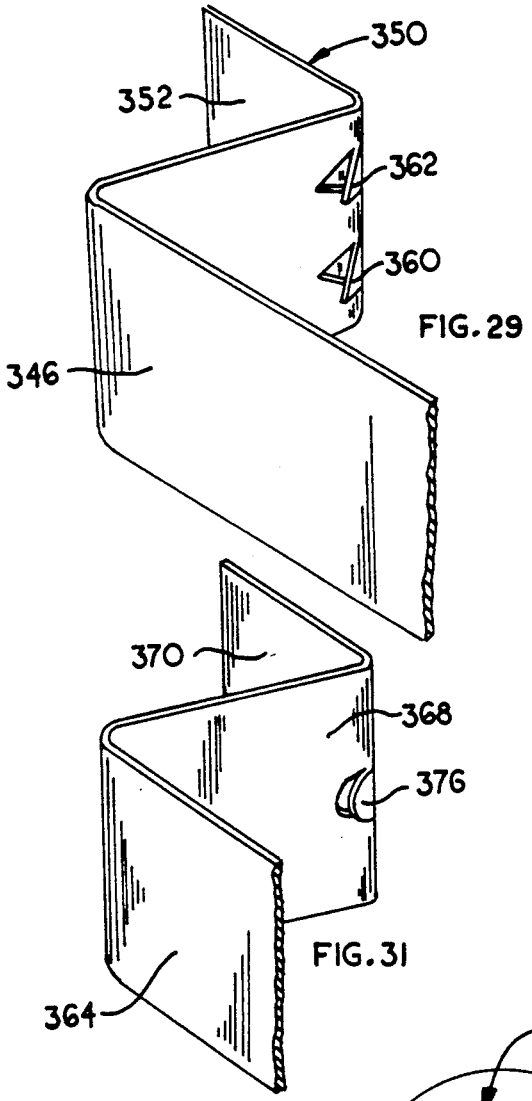
FIG. 29
FIG. 31
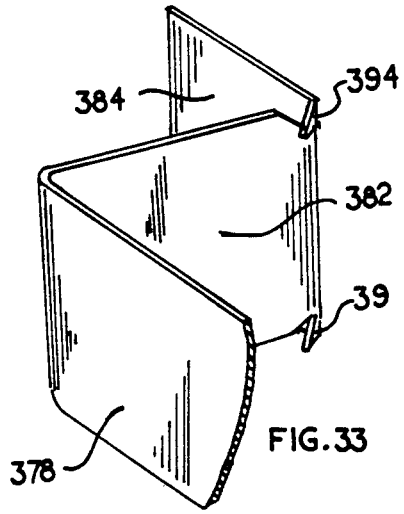
FIG. 33
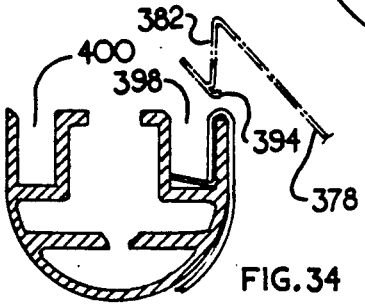
FIG. 34
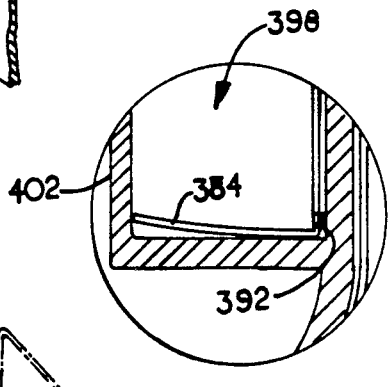
FIG. 35

PANEL DEVICE

This application is a divisional application of application Ser. No. 07/144,166 filed Nov. 25, 1985 now U.S. Pat. No. 4,922,931.

This invention is concerned with portable, flexible, panel devices which can be used to display information at trade shows and conventions. The panel device of this invention is also useful in the furniture arts. Panel devices as may be used at trade shows or conventions are of two principle types, these being the large bulky type and the portable type. This invention is concerned with the portable type of display device. The portable display devices have become very popular in recent years for utilization at regional trade shows and conventions. These portable display devices, when assembled, present a nice impression and have a very high display surface to weight ratio. Further, these portable display devices are advantageous in that they can be quickly and easily assembled and disassembled without tools by one person. In contrast, the large bulky display devices as mentioned above are very heavy and hence have a low display surface to weight ratio. Further, these display devices can be assembled and disassembled only with great difficulty by extra workmen at great expense.

The subject invention is useful in connection with portable display devices wherein a plurality of display panels are attached to channels which in turn function as supporting means. It is often desirable to locate the panels of a display device in angular relationship with each other. It is in this area where the subject invention is useful. In accordance with this invention the panels of the device of this invention can be located in any desired relationship with each other over a 360 arc.

This invention also includes the connector system which is useful in holding component parts of a display device in fixed relationship with each other. Also included in this invention is a vertical support which interacts with a double hinge system. The invention is also concerned with a unique double hinge system which allows rotation through a 360 arc.

DESCRIPTION OF THE DRAWINGS

FIG. 1 is a front view showing a section of the subject panel device.

FIG. 2 is an end view along line 2—2 of FIG. 1 showing the vertical supports of the panel device in parallel relationship with each other.

FIG. 3A is a top sectional view showing the two panels in parallel relationship to each other.

FIG. 3B is a top sectional view showing two panels in a straight line relationship with each other.

FIG. 3C is a top sectional view showing two panels in parallel relationship with each other opposite of that shown in FIG. 3A.

FIG. 4 is a cross section along line 4—4.

FIG. 5 is a perspective view showing the clip hinge element of this invention.

FIG. 6 is a perspective view showing the placement of a pair of hinges on a pair of vertical supports.

FIG. 7 is a side view showing the panel device of this invention wherein three panels are interconnected.

FIG. 8 is a top view of the three panel structure of FIG. 7.

FIG. 8A is a top view of the three panel structure of FIG. 7 in angular relationship.

FIG. 17 is a front view of an embodiment of a panel device in accordance with this invention showing means for displaying panel indicia.

FIG. 18 is a perspective view showing the placement of indica in the panel device of FIG. 17.

FIGS. 19 and 20 are side views showing the means for incorporating additional panels into the panel device of this invention.

FIG. 21 is a side view showing a leg structure for use with this invention.

FIG. 22 is a perspective view of a notched vertical support.

FIGS. 23 and 24 are side views showing notched vertical supports.

FIG. 23B is a section view through line 23B of FIG. 23A.

FIG. 25 is a perspective view showing an alternate clip hinge element structure having locking tabs.

FIG. 26 is a perspective view showing the placement of a pair of clip hinge elements as shown in FIG. 25 onto a pair of vertical supports.

FIG. 27 is a cross section view showing the placement of the alternate clip hinge structure with locking tabs of FIG. 25 in vertical supports.

FIGS. 28 and 29 are perspective views of clip hinge elements with locking teeth.

FIGS. 30 and 31 are perspective views of clip hinge elements with locking burrs.

FIGS. 32 and 33 are perspective views of clip hinge elements with locking spurs.

FIGS. 34 and 35 are end views showing the placement of the clip hinge elements of FIGS. 28 to 33 in a vertical support.

DESCRIPTION OF THE PREFERRED EMBODIMENT

Figure 6A:
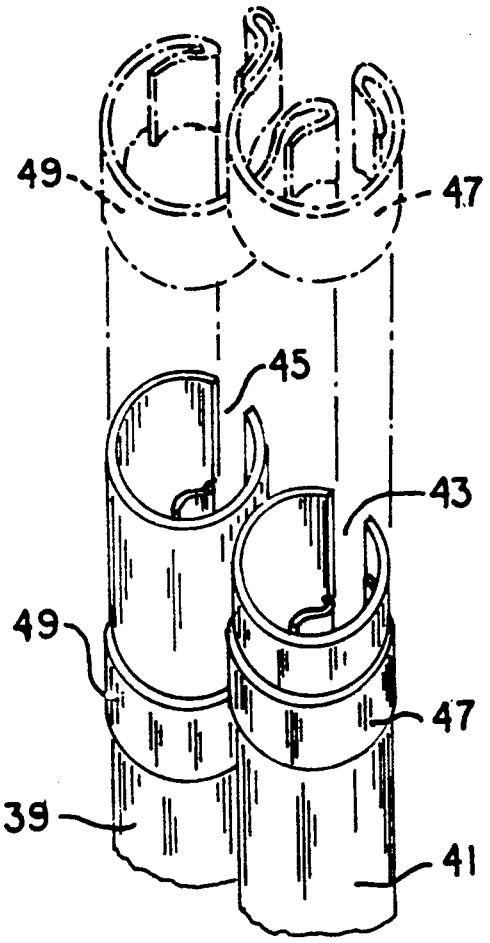
FIG. 6A is a perspective view showing the placement of a pair of hinges on a pair of round vertical supports.

The subject invention relates to a panel device which comprises a plurality of vertical supports which are secured in parallel relationship with each other with a plurality of strap double hinges. Panels may be spaced between the vertical supports. The parallel relationship of the vertical supports may be further defined by interconnecting horizontal supports. The combination of the vertical supports and horizontal supports define a frame which may be square or rectangular. Secured within each frame so defined is a panel member.

As is mentioned hereinabove the subject panel device is particularly useful in the portable display arts. It should be noted however that the panel device of this invention is also useful in the furniture arts. The subject panel device can be fabricated in such a size that it can be used for example as a room divider, office separator, privacy screen or noise barrier. In the furniture arts the panel device at hand is particularly useful in that the various panels can be angularly disposed in relation to each other to define any given surface area. If so desired these panel members can be locked into relationship with each other.

Referring to FIG. 1 it can be seen that the panel device of this invention 2 comprises a pair of vertical supports 4 and 6, a pair of horizontal supports 8 and 10 and a panel 12.

As is shown in FIG. 1 and 2, pairs of adjacent vertical supports 6 and 14 are rotatably connected to each other via a plurality of clip hinge elements 16,18,20 and 22. These clip hinge elements cooperate with and grip the vertical supports in a manner which will be described hereinbelow.

FIGS. 3A, 3B and 3C illustrate how related panel devices can be rotated through a 360 degree arc in relation to each other. In FIG. 3A it can be seen that into vertical supports 6 and 14 are secured panels 12 and 24. In FIG. 3A panels 12 and 24 are in parallel relationship with each other. In FIG. 3B vertical support 6 has been rotated in the direction of arrow 26. As a result of this rotation, panels 12 and 24 are now in a straight line relationship with each other.

In FIG. 3C the rotation of vertical support 6 in relation to vertical support 14 is continued in the direction of arrow 28.

Upon completion of rotation in the direction of arrow 28 panels 12 and 24 are again in parallel relationship with each other. In comparing FIG. 3A to FIG. 3C it can be seen that panel 12 has been rotated 360 in relation to panel 24. It is understood by one skilled in the art that this rotation of panels 12 and 24 in relation to each other could be stopped at any point to achieve any desired angular relationship of panels 12 and 24.

Vertical supports 6 and 14 incorporate a plurality of integral lips 30,32,34 and 36. Panels 12 and 24 are scored in such a manner that lips 30,32,34 and 36 are adapted to grip said scored portion.

Panels 12 and 24 may be formed from a material which may be readily scored such as a foam board. The manner in which panels 12 and 24 may be scored and positioned in vertical supports 6 and 14 and gripped by lips 30,32,34 and 36 is described in detail in U.S. Pat. No. 3,662,807 issued May 16, 1972.

The rotation of panels 12 and 24 and vertical supports 6 and 14 is made possible by the fact that adjacent vertical supports 6 and 14 are interconnected with each other by two or more double hinges which comprise clip hinge elements 16,18,20 and 22.

FIG. 4 is a section taken along line 4—4 of FIG. 1. In this figure the attachment of the second clip hinge element 20 to vertical supports 6 and 14 can be seen.

From FIG. 6 it can be seen that a composite hinge 35 consists of a pair of clip hinge elements 18 and 20. It can further be seen that clip hinge elements 16 and 20 can be easily slipped on to vertical supports 6 and 14. Adjacent vertical supports 6 and 14 are attached to each other by the placement of clip hinge elements 18 and 20 on to vertical supports 6 and 14.

The structure of clip hinge element 18 can be further seen from an examination of FIG. 5. Clip element 18 comprises a main body portion 37 which is formed from a suitable flexible material and a pair of opposing end portions 40 and 42. End portions 40 and 42 comprise reverse bends. In order to interlock with adjacent vertical supports and stay in tension during rotation the reverse bends of end portions 40 and 42 must be opposite of each other. Clip hinge element 18 may be formed from any suitable flexible material such as a metal or polymeric material For example, clip hinge element 18 can be formed from a thermoplastic polymeric material such as a poly alpha olefin. If clip hinge 18 is formed from a thermoplastic material, reverse bend end portions can be formed by a thermal bending process. Clip hinge elements complete with reverse bend end portions may also be formed by injection molding.

In order to be functional in this invention the reverse bends of the clip hinge element must be opposite of each other. From a further examination of FIG. 5 the meaning of the term opposite of each other can be ascertained. In FIG. 5 it can be seen that end portions 40 and 42 are on opposite sides of main body portion 37. It can further be seen that openings 40A and 42A open in directions which are 180 degrees out of phase with each other. That is openings 40A and 42A are opposite of each other. That openings 40A and 42A are opposite of each other is further exemplified by arrows 40B and 42B.

Clip hinge element 18 can likewise be formed from a metal with reverse bend end portions being formed from a precut section of metal by a suitable bending process. If a thermoplastic material is used, it has been found that, for portable display devices, a width of approximately 0.5 inches and a thickness of about 0.030 inches is desirable. When the clip hinge elements are formed from metal half hard to three fourths hard stainless steel is the preferred metal for use in accordance with this invention. Further these stainless steel elements should have a width of approximately 0.5 inches and a thickness of approximately 0.007 inches. In the preferred embodiment half hard 0.007 inches thick 304 stainless steel is utilized.

As is illustrated in FIG. 6 each end of a pair of vertical supports 6 and 14 utilize a pair of clip hinge elements 18 and 20. The opposite end of said pair of vertical supports also utilize a pair of clip hinges not shown.

Pairs of hinges are utilized as during rotation in relation to each other over 360 degree stress is alternately applied and released to cooperating clip hinge elements 18 and 20 depending on the respective position of vertical supports 6 and 14.

FIG. 6A shows another embodiment of a suitable vertical support and related clip hinge elements. In this structure the vertical supports 39 and 41 have integral slots 43 and 45. The structure of vertical supports 39 and 41 is described in detail herein below in connection with FIG. 11B.

Vertical supports 39 and 41 are bound together by clip hinge elements 47 and 49 which form a double hinge.

Figure 6B:
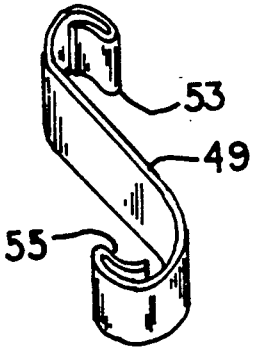
FIG. 6B is a perspective view showing a clip hinge element which is adapted to a pair of round vertical supports.

FIG. 6B shows in greater detail the structure of clip hinge element 49. It can be seen that clip hinge element 49 has a pair of reverse bend end portions 53 and 55 which are adapted to engage vertical supports 39 and 41.

Figure 6C:
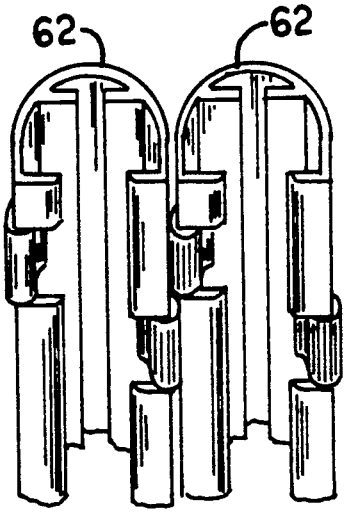
FIG. 6C is a perspective view showing a pair of the vertical supports of FIG. 11C secured with clip hinge elements.

FIG. 6C shows the connection via a clip hinge element 67 of a pair of the vertical supports 62 as are described in greater detail in connection with FIG. 11C. FIG. 6D shows in greater detail clip hinge element 67 which is adapted to vertical supports 62.

Any number of composite structures 2 can be interconnected in series in order to produce a display device of the desired size. Likewise three or more composite panel devices can be interconnected if it is desired to have a panel device in which the three or more panels can rotate in relation to each other. As can be seen in FIG. 7,8 and 8A three composite panels 38,40 and 42 are hooked together. These composite panels consist of three vertical supports 44,46 and 48. These vertical supports are interconnected by four clip hinge elements 50,51,52 and 54. With this structure composite panels 38 and 42 can be rotated in relation to central panel 40 in the direction of arrows 56 and 58.

Figures 9, 9A, 10A, 10B, 10C, 11A, 11B, 11C, 12, 13, 14, 15, 16:
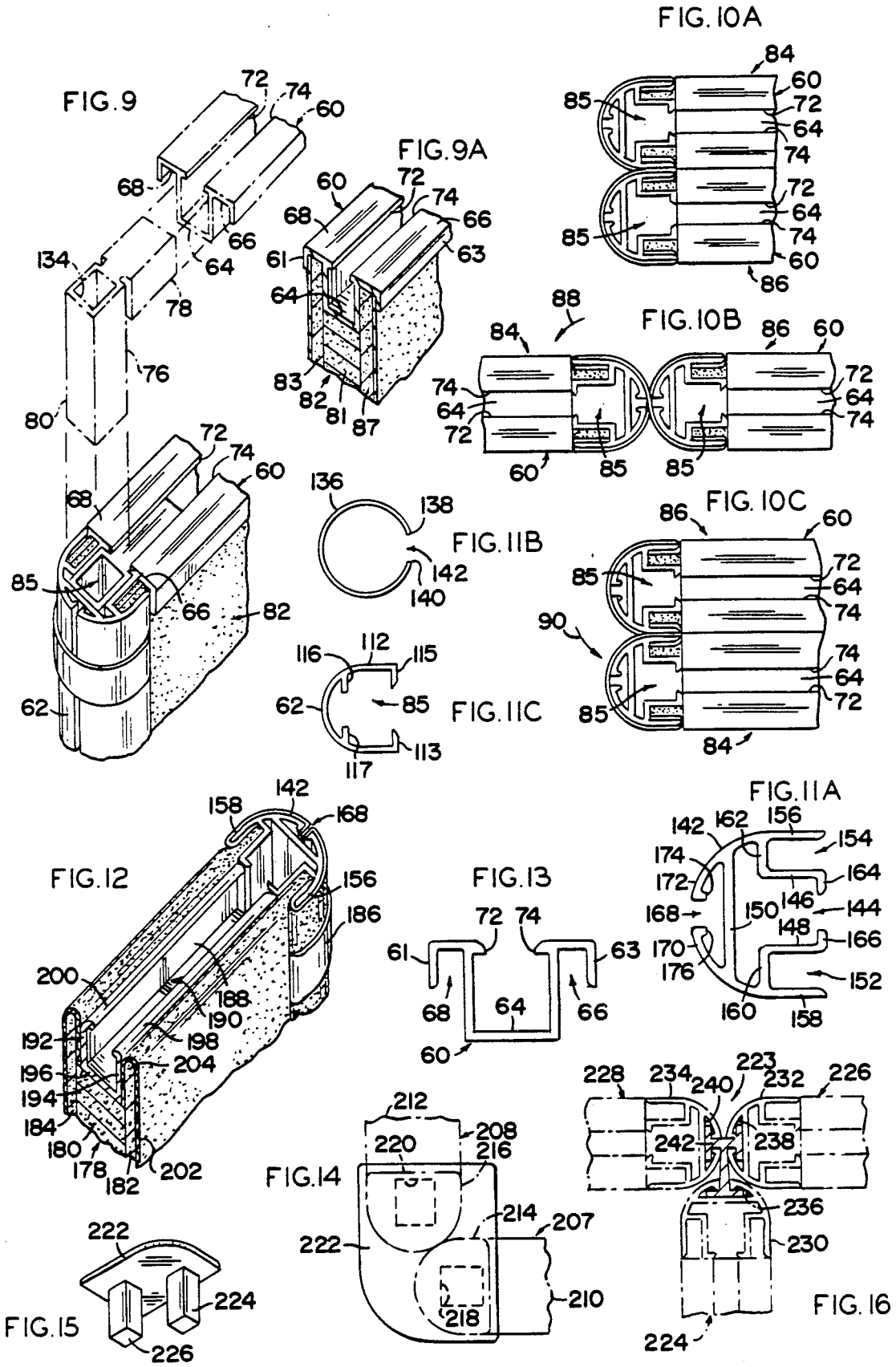
FIG. 9 is a perspective view showing the interconnecting of horizontal and vertical members with a connector plug.
FIG. 9A is a perspective view showing the cooperation of the horizontal member with a panel.
FIG. 10A is a top view showing two panels in a parallel line relationship with each other wherein the panel is secured by edge plies.
FIG. 10B is a top view showing two panels in a straight line relationship with each other wherein the panel member is secured by edge plies.
FIG. 10C is a top view showing two panels in parallel relationship with each other opposite of that shown on FIG. 10A wherein the panel is secured by edge plies.
FIG. 11A is a cross section of the preferred embodiment of a vertical support which is useful in this invention.
FIG. 11B is a cross section of a simplified embodiment of a vertical support.
FIG. 11C shows another embodiment of a vertical support.
FIG. 12 is a perspective view showing means whereby the fabric covering of the panel can be wrapped around the panel device components.
FIG. 13 is a cross section view of a horizontal support.
FIG. 14 shows the connection of two panels and related vertical supports in fixed relationship with each other.
FIG. 15 is a perspective view showing a connector plug for connecting two panels in fixed relationship with each other.
FIG. 16 is a top plan view showing the connection of a plurality of vertical supports and related panels.

FIG. 9 illustrates one embodiment of a horizontal support 60 and the attachment of this horizontal support to vertical support 62. Horizontal support 60 incorporates U shaped sections 64,66 and 68. As is illustrated, the open end of U-shaped sections 66 and 68 are opposite the open end of U-shaped section 64. U-shaped section 64 further incorporates a pair of opposing lips 72 and 74. In order to connect horizontal support 60 to vertical support 62 a connector plug 76 is inserted into the aperture which is defined by U-shaped channel 64 and lips 72 and 74 and secured therein with a mechanical fastener or an adhesive. The opposite end 80 of connector plug 76 is in turn inserted into aperture 85 of vertical support 62.

The function of connector plug 76 is clearly shown in FIG. 9. For the sake of clarity in the drawings similar connector plugs are not shown in FIGS. 3A, 3B, 3C, 10A, 10B, 10C and 12.

Further from FIG. 9 and 9A it can be seen that horizontal support 60 is adapted to engage panel 82 via U-shaped channels 66 and 68. Panel 82 comprises a central core 81, for example a honeycomb core, and a pair of outer plies 83 and 87. The core 81 is cut or crushed inwardly to the depth of U shaped channel 64, outer plies 83 and 87 of panel 82 may then be inserted into U-shaped channels 66 and 68. In this manner it can be seen that horizontal support 60 and panel 82 are securely interconnected. Likewise horizontal support 60, vertical support 62 and panel 82 are securely interconnected to each other to form a strong, unitary panel device.

FIGS. 10A, and 10B and 10C further illustrate how panels and related horizontal and vertical supports may be rotated in relation to each other. In these figures panels 84 and 86 are rotated 360 degree in relation to each other in the direction of arrows 88 and 90.

An integral part of the subject invention is the vertical support system, the function of which has been described hereinabove. In its simplest embodiment in accordance with this invention the individual vertical supports must incorporate a means for engaging the clip hinge elements and a means for engaging panel members. Suitable vertical supports are illustrated in FIGS. 11A, 11B and 11C.

FIG. 11A illustrates the preferred embodiment of a vertical support for use in this invention. In this structure vertical support 142 incorporates a central U shaped opening or channel 144 which is defined by sides 146 and 148 and a bight 150. This vertical support also incorporates a pair of U shaped channels 152 and 154. U-shaped channel 154. U-shaped channel 154 is defined by sides 146 and 156 and bight 162. Conversely U-shaped channel 152 is defined by sides 148 and 158 and bight 160. The reverse bends of the clip hinge elements as are illustrated in FIG. 5 engage sides 156 and 158 of vertical support 142. Vertical support 142 further incorporates a pair of lips 164 and 166 which further define U-shaped opening 144. Lips 164 and 166 are adapted to engage score lines which are an integral part of the panel portion, not shown, in a manner as described herein above. The rear portion of vertical support 142 incorporates an opening 168 which is defined by legs 170 and 172. Legs 170 and 172 in turn incorporate a pair of opposing lips 174 and 176. Opening 168 is useful in that vertical support 142 may be covered with a fabric. This fabric is tucked around the leading edge of sides 156 and 158 behind the reverse bend section of the strap hinge element. The opposite end of the covering fabric is tucked into opening 168 and secured via lips 174 and 176.

FIG. 11B represents the simplest form of a vertical support which may be used in accordance with this invention. In this embodiment vertical support 136 comprises a section of tubing which has part of its circumference cut away in such a manner that lips 138 and 140 are formed. The opening 142 which is defined by lips 138 and 140 is adapted to receive a panel member in the manner as described hereinabove. The reverse bends of the embodiment of clip hinge element illustrated in FIG. 5 is adapted to slip around lips 138 and 140.

FIG. 11C illustrates still another embodiment of a vertical support. In this structure vertical support 62 comprises a half round extrusion having a central U shaped opening 85 which is defined by sides 112 and 114, and by bights 116 and 117. Lips 113 and 115 further define U shaped opening 85. Suitable clip hinge elements can engage lips 113 and 115 and a suitable panel member can be positioned in U shaped opening 85 between lips 113 and 115.

Accordingly, it can be seen that if desired a plurality of vertical supports may be used in a manner as was described in reference to FIGS. 1, 2 and 6 hereinabove.

Vertical and horizontal supports as described may be formed from any convenient material. These supports may be extruded from a thermoplastic material such as a poly alpha olefin or a nylon. In the preferred embodiment these elements are aluminum extrusions. Cosmetics and color combinations are very important in displaying devices which are used at trade shows. In this connection vertical and horizontal supports may be colored or painted to achieve any desired effect. If colored vertical and or horizontal supports are desired in the preferred embodiment this coloring is achieved by anodizing or painting of the aluminum extrusions.

FIG. 12 illustrates a panel device in accordance with this invention wherein both the vertical and horizontal supports are completely covered with a fabric. In this embodiment fabric is rolled around vertical support 142. One end of the fabric is tucked into opening 168, the other end of the fabric is tucked around the edges of sides 156 and 158 as was described in connection with FIG. 11A.

Panel 178 comprises a central core 180 and a pair of opposing plies 182 and 184. Plies 182 and 184 are biased into and secured in U shaped channels 152 and 154 by the biasing of the reverse bend portion of clip hinge element 186. In this instance horizontal support 188 is U shaped and has a central opening 190 which is defined by sides 192 and 194, bight 196 and lips 198 and 100. Fabric layer 202 covers ply 182 and is tucked around the uppermost edge 204 of ply 182 and between side 194 of horizontal support 188 and ply 182. Horizontal support 188 and vertical support 142 can be interconnected via a connector plug such as plug 76 as is described above in connection with FIG. 9.

The structure of FIG. 12 is advantageous in that if a plurality of panel devices are stacked on top of each other both the horizontal and vertical supports are fully covered with fabric 202, in such a manner as to present a very pleasing and uniform appearance.

FIG. 13 shows in greater detail particulars of horizontal support 60. Horizontal support 60 incorporates a pair of U shaped channels 66 and 68. Channels and 68 are adapted to receive the outer plies 83 and 85 of panel 82 as has been described hereinabove in connection with FIGS. 9 and 9A. Horizontal support 60 further incorporates a pair of opposing lips 72 and 74. Opposing lips 72 and 74 are adapted to engage connector plug 76 as is shown in FIG. 9.

While the panel device of this invention is very desirable in that the panels can be moved through a 360 degree arc after movement in some usage it is desirable to lock a plurality of panels in fixed relationship with each other. One mode of locking panels in relationship with each other is illustrated in FIG. 14. In this embodiment two panels 207 and 208 incorporate horizontal supports 210 and 212 which are identical to horizontal support 60 as described above in reference to FIGS. 9 and 9A. Horizontal supports 210 and 212 are connected to vertical supports 214 and 216 via a pair of connector plugs not shown. Referring to FIG. 9 it can be seen that the vertical leg of connector plug 76 is hollow and incorporates a square aperture 134 which is analogous to aperture 218 and 220 as is illustrated in FIG. 14. Panels 207 and 208 are secured in fixed relationship with each other by placing a locking plug 222 into apertures 218 and 220. The details of locking plug 222 are better illustrated in FIG. 15. Locking plug 222 incorporates a pair of square downward depending legs 224 and 226. When legs 224 and 226 are placed into aperture 218 and 220 panels 210 and 212 are secured in fixed relationship with each other. That is because the spacing of legs 224 and 226 is fixed, the spacing of aperture 218 and 220 is in turn fixed which in turn fixes the relationship of panels 207 and 208.

While legs 224 and 226 and corresponding apertures 218 and 220 are illustrated as square it is understood by one skilled in the art that these components could be round or any convenient shape.

FIG. 16 illustrates still another embodiment of this invention wherein a plurality of panels can be locked into position with each other. As was described in reference to FIG. 11A vertical support 142 incorporates an opening 168 which is adapted to receive the ends of fabric which is used to cover the vertical support. FIG. 16 illustrates a composite panel device 223 which incorporates three panels 224,226 and 228 and three vertical supports 230,232 and 234. These vertical supports in turn have as an integral part thereof openings 236, 238 and 240. In order to lock panels 224, 226 and 228 of composite panel device into a fixed relationship with each other a locking plug 242 is inserted into openings 236,238 and 240.

Locking plugs 222 and 242 as are described in reference to FIGS. 15 and 16 can be formed from any convenient material such as a metal or a polymeric material. In the preferred embodiment these plugs are injection molded from a durable thermoplastic such as a poly alpha olefin or a nylon. FIGS. 15 and 16 illustrate the locking of two and three panels together, it is understood that any convenient number of panels can be locked together.

FIGS. 17 and 18 illustrate an embodiment of this invention wherein a display device 248 can be used to protect and display large sheet items such as photographs. Display device incorporated a pair of opposing vertical supports 250 and 252 which may be connected to additional adjacent vertical supports, not shown, in a manner as described hereinabove. In this structure a horizontal support is positioned over the top edge of panel 256. Sides 258 and 260 of U shaped horizontal support 254 are positioned downwardly over panel 256. The upper edge of panel 256 is positioned in and gripped by lips 262 and 264 of vertical support 254. With this positioning a space exist between side 260 of horizontal support 254 and side 266 of vertical support 250. This space is adapted to receive an indica sheet 268 which may be a poster or a photograph and a transparent protective sheet 248. By using this structure inexpensive art work such as a photograph can be readily displayed and changed at ease in the display device of this invention. The composite structure may then be covered by a cap channel 251 which is held in place with clips 253 and 255.

FIGS. 19 and 20 illustrate an embodiment of this invention wherein a cantilever header may be placed on a panel device. In this structure vertical support 282 is adapted to receive and support panels in a manner as described herein above. A cantilever header if formed by the connection of a section 284 of the extrusion, which is used to form the vertical support, to vertical support 282 by use of a connector brace 286. Legs 288 and 290 of connector brace 286 are positioned in opening 168 as is shown and described herein above in connection with FIG. 11A. By use of this structure a section 284 and an opposing identical section on the next adjacent vertical support not shown, can be used to form a cantilever header. To form said header a panel is secured in section 284 and its adjacent counterpart.

FIG. 21 illustrates an embodiment wherein a leg support 292 may be added to the panel device of this invention in order to give it greater lateral support. Leg support 292 comprises a base section 294 and a connector leg 296. A screw locked stop 298 is secured to connector leg 296. Connector leg 296 is positioned in vertical support 300 into opening 144 which is illustrated and described in detail herein above in connection with FIG. 11A.

FIGS. 22,23A, 23B and 24 illustrate modifications of the edges of vertical support 302 and 304. As was described above in reference to FIGS. 5 and 6 the clip hinge elements wrap around and engage the outer edge of the vertical support. In order to prevent the clip hinge elements from moving on vertical supports 302 the outer edges of this vertical support can be notched as per notches 306 and 308. In operation the edges of the clip hinge element engages the edges of notches 306 and 308 in such a manner that adjacent vertical supports can not ride up or down in relation to each other or to the clip hinge. From FIG. 22 and 23B it can be seen that inner edge 305 of notch 308 is tapered outward in relation to bottom edge 307.

FIG. 25 shows an alternate clip hinge element 310 for use in accordance with this invention. Clip hinge element 310 incorporates a main body portion 312 and a pair of reverse bend end portions 314 and 316. Reverse bend end portions 314 and 316 further incorporates locking tabs 318 and 320. The plane of locking tabs 318 and 320 is approximately at right angles to the plane of reverse bend end portions 314 and 316. Locking tabs 318 and 320 assist in locking clip hinge elements into the vertical supports.

FIG. 26 shows the placement of a pair of clip hinge elements 321 and 322 onto a pair of vertical supports 324 and 326. When clip hinge elements 321 and 322 are placed onto vertical supports 324 and 326 these vertical supports are rotatably secured in relationship to each other. In operation another pair of clip hinge elements, not shown, would be placed on the opposite end of vertical supports 324 and 326. FIG. 27 shows in detail how the clip hinge element of FIG. 25 cooperates with the various parts of the vertical support. As was discussed in detail in connection with FIG. 11A the preferred cross section for the vertical support incorporates a pair of outboard U shaped channels. In vertical support 324 and 325 these outboard U shaped channels are identified as 328, 329. 330 and 331. Channels 328, 329, 330 and 331 have bights 332, 333, 334 and 335. Locking tab 339 of clip hinge element 337 has a width which is approximately equal to the width of bight 332. Because of the snug fit of locking tab 339 into U shaped channel 32B the leading edge of locking tab 339 is biased against the inner wall 326 of U shaped channel 328. Conversely reverse bend portion 340 is biased against outer wall 327 of U shaped channel 328. As a result of this biasing against both walls 326 and 327 clip hinge element 337 is securely fastened in and to vertical support 324. Accordingly when vertical support 324 and 325 are rotated in relation to each other the clip hinge elements will not move in relation to the vertical support. Notches cut into the edge of the vertical supports, as is described in connection with FIGS. 22, 23A, 23B and 24, likewise secure the relationship of the clip hinge elements in relation to the vertical supports. The biasing of clip hinge element 337 into U shaped channel 328 has been described. From an examination of FIG. 27 it can be seen that similar biasing likewise occurs in connection with U shaped channels 329, 330 and 331.

In the subject invention in order to allow opposing pairs of vertical supports to be in close proximity to each other it is imperative that the clip hinge members be formed from a thin flexible material. Because these clip hinge elements are very thin the hinge takes up minimal room between the vertical supports.

In use the clip hinge elements are under high stress. As a result of this high stress in some applications the clip hinge elements have a tendency to uncoil or slip out of the U shaped channels which are an integral part of the vertical supports. In order to aleviate this problem the locking tabs which are a part of the clip hinge elements have proven to be extremely useful. From a further examination of FIG. 27 it can be seen that clip hinge element 337 is prevented from unwinding out of U shaped 328 by the action of locking tab 339. As is explained above locking tab 339 biases reverse bend 340 into U shaped channel 328. In use high stresses are placed on clip hinge element 337 in the direction of arrow 341. The subject embodiment uses the stresses to prevent the unwinding of the clip hinge element 337 out of U shaped channel 328. When stress is placed on clip hinge element 337 in the direction of arrow 341 locking tab 339 is biased into the inner wall of U shaped channel 328. In the preferred embodiment clip hinge element 337 is formed from a stainless steel which is much harder than the material from which vertical support 324 is formed. Due to this difference in hardness the end of locking 339 digs into the inner wall of U shaped channel 329 thereby securing clip hinge element 337 into vertical support 324. As a result of this securing the clip hinge elements of this invention are effectively attached to the vertical supports without the use of extraneous fasteners.

FIGS. 28 to 33 describe further alternate embodiments of clip hinge elements and having locking tabs which further have projections which bite into and engage the U shaped channels of the vertical supports.

FIGS. 28 and 29 show an embodiment of a clip hinge element 346 having a pair of reverse bend portions 348 and 350. Reverse bend portions 348 and 350 further incorporate locking tabs 352 and 354 These locking tabs in addition have integral teeth 356, 358, 360 and 362. The operation of which will be described herein below.

FIGS. 30 and 31 likewise illustrate another embodiment of a clip hinge element which is suitable for use in this invention. In this embodiment clip hinge 364 has a pair of integral reverse bend portions 366 and 368. These reverse bend portions further incorporate locking tabs 370 and 372. Integral with these locking tabs are burrs 374 and 376 the operation of which will be described herein below.

Likewise FIGS. 32 and 33 show still another embodiment of a clip hinge element 378 which is suitable for use in this invention. Clip hinge element 378 has a pair of reverse bend portions 380 and 382 which further incorporate locking tabs 384 and 386 These locking tabs have integral spurs 388, 390, 392 and 394. FIGS. 34 and 35 illustrate the placement of the alternate embodiments of the clip hinge elements, as are shown in FIGS. 28 to 33 in a vertical support. It can be seen that vertical support 396 has a pair of U shaped channels 398 and 400. These Figures show the placement of clip hinge element 378 into U shaped channel 398. When clip hinge element 378 is positioned in U shaped channel 398 locking tab 384 is biased against wall 402 of U shaped channel 398. Locking tab 384 may be slightly longer than the width of U shaped channel 398. As a result of this biasing of locking tab 384 into U shaped channel 398 spurs 392 and 394 are biased against and dig into wall 404 of U shaped channel 398. As a result of this engagement clip hinge element 378 is secured into U shaped channel 398. Accordingly when stress is placed on clip hinge element 378 it will not unwind or uncoil out of U shaped channel 398.

The teeth of clip hinge element 346 and burrs of clip hinge element 364 cause these respective clip hinge elements to be secured into the U shaped channels of vertical supports in a like manner.

In the preferred embodiment of this invention the material from which the clip hinge elements are formed is much harder than the material from which the vertical supports are formed. Because of this hardness difference the locking tabs teeth burrs and spurs of the clip hinge elements are described above dig into and engage the vertical supports. It is preferred that the clip hinge elements be formed from a thin band of stainless steel and the vertical supports be an aluminum extrusion.

Here It can be seen that the panel device of this invention can be easily assembled, therefore the labor content of the panel device of this invention is substantially less than that of comparable prior structures.

The integral hinge system of this invention is likewise very desirable in that a superior panel device is produced from an aesthetic point of view. In the prior art wherein separate extraneous hinges are used these hinges are attached by extraneous fasteners accordingly the aesthetic property of the resulting panel device are detrimentally affected. That is it does not enhance the appearance of a panel device to have hinge members and related fasteners protruding therefrom. In contrast the panel device of this invention has a clean, uniform pleasing appearance because the integral components thereof react with each other. Another advantage of this invention is that the vertical supports are secured together with clip hinge elements which are formed from thin sections of a flexible material, such as a band of stainless steel. Because these clip hinge elements are thin opposing vertical supports are in close proximity to each other. As a result of this closeness the gap between the vertical supports is minimal. Having the minimum gap between the vertical supports is highly desirable in the portable display art as any light penetrating through a display greatly detracts from the aesthetic qualities of the display.

Lastly on a strength to weight ratio the panel device of this invention is exceptionally high. In the prior art the vertical supports are connected with various hinge elements via extraneous fasteners. These extraneous fasteners are secured in a plurality of holes which are drilled into the vertical supports. The drilling of these holes weakens these vertical supports and hence they are subject to failure in a severe load bearing situation. In contrast with this invention because the reverse bend portions of the clip hinge elements interact with the integral U shaped channels of the vertical support therefore, holes need not be drilled in the vertical supports. Because the vertical supports are free of holes the resulting display device has a high strength to weight ratio.

For the reasons as set forth herein the subject invention results in a superior panel device. From the above description and from FIGS. 1 to 35 it can be seen that the subject invention can be used to produce a wide variety of panel devices. It is understood by one skilled in the art that this invention is not limited to the embodiments as described and illustrated herein above.

What is claimed is:

1. A vertical support which is useful in a panel device, said vertical support having an elongated body portion and a cross section which has a central U-shaped channel which is flanked on opposite sides by a pair of second U-shaped channels wherein the vertical support opposite of the opening of said U-shaped channels is arcuate so as to prevent interference of the vertical support with hinge means which may be associated therewith.

2. The vertical support of claim 1 wherein said central U shaped channel incorporates means for receiving and securing a panel member.

3. The vertical support of claim 1 wherein said central U shaped channel incorporates means for receiving and securing a panel member and wherein said second U shaped channels are adapted to receive and secure clip hinge elements having reverse bend portions.

4. The vertical support of claim 1 wherein said central U shaped channel incorporates means for receiving a panel member and wherein said pair of second U shaped channels are adapted to receive and secure reverse bend portions of clip hinge elements and panel elements wherein said central U shaped channel and said pair of second U shaped channels are in parallel axial relationship with each other and wherein said vertical support is notched in order to prevent axial movement of the clip hinge element on the vertical support.

5. The vertical support of claim 1 wherein said central U shaped channel incorporates means for receiving a panel member and wherein the pair of second U shaped channels are adapted to receive and secure reverse bend portions of clip hinge elements and panel elements wherein the vertical support incorporates an opening adjacent to the bight of said central U shaped channel the opening having an elongated slot opposite said central U shaped channel and is adapted to receive members which will secure two or more vertical supports in fixed relationship with each other and wherein said vertical support is notched in order to prevent axial movement of the clip hinge element on the vertical support.

6. The vertical support of claim 1 which is formed from a member selected from the group comprising a metal or a polymeric material.

7. The vertical support of claim 5 wherein said vertical support is formed from extruded aluminum or a polymeric material.

* * * * *